US011047554B2

(12) United States Patent
Bokros et al.

(10) Patent No.: US 11,047,554 B2
(45) Date of Patent: Jun. 29, 2021

(54) ADJUSTABLE TRIM COLLAR FOR A LIGHT FIXTURE

(71) Applicant: SIGNIFY HOLDING B.V., Eindhoven (NL)

(72) Inventors: Jay P. Bokros, Senoia, GA (US); Charles Vasquez, Peachtree City, GA (US); Jason Q. Paulsel, Peachtree City, GA (US)

(73) Assignee: SIGNIFY HOLDING B.V., Eindhoven (NL)

( * ) Notice: Subject to any disclaimer, the term of this patent is extended or adjusted under 35 U.S.C. 154(b) by 100 days.

(21) Appl. No.: 16/120,053

(22) Filed: Aug. 31, 2018

(65) Prior Publication Data

US 2020/0072444 A1 Mar. 5, 2020

(51) Int. Cl.

| | |
|---|---|
| ***F21V 17/00*** | (2006.01) |
| ***F21V 21/04*** | (2006.01) |
| ***F21V 14/04*** | (2006.01) |
| ***F21V 7/00*** | (2006.01) |
| ***F21S 8/02*** | (2006.01) |

(52) U.S. Cl.
CPC ..... *F21V 17/002* (2013.01); *F21V 7/0025* (2013.01); *F21V 14/04* (2013.01); *F21V 21/047* (2013.01); *F21S 8/026* (2013.01)

(58) Field of Classification Search
CPC ..... F21V 17/002; F21V 7/0025; F21V 14/04; F21V 21/047; F21S 8/026
USPC ..... 362/297
See application file for complete search history.

(56) References Cited

U.S. PATENT DOCUMENTS 8,405,947 B1 * 3/2013 Green ..... F21S 8/026 361/103
9,062,866 B1 * 6/2015 Christ ..... F21V 17/12

* cited by examiner

*Primary Examiner* — Andrew J Coughlin
*Assistant Examiner* — Jessica M Apenteng

(57) ABSTRACT

A light fixture includes a housing, a light module, and a trim assembly. The trim assembly includes a trim body, an upper flange, and an adjustable collar attached to the upper flange. The adjustable collar can attach to the upper flange in a plurality of different positions easily permitting adjustment of the orientation of the trim assembly with respect to the housing.

11 Claims, 4 Drawing Sheets

ADJUSTABLE TRIM COLLAR FOR A LIGHT FIXTURE

TECHNICAL FIELD

Embodiments of the technology relate generally to light fixtures and more particularly to a light fixture trim that is easily adjustable.

BACKGROUND

Light fixtures (or luminaires) often include multiple components, such as a housing and a light module containing a light source. Light fixtures that are recessed often include a trim, also referred to as a trim assembly or finishing section. Recessed light fixtures are typically installed in a ceiling and the trim can perform light reflecting or altering functions, as well as provide an aesthetically pleasing appearance for the recessed light fixture.

Some recessed light fixtures have trims called directional trims that are configured to reflect light from the light fixture in a particular desired direction, such as towards a wall or display. In certain situations, the housing for the light fixture must be installed in a particular orientation so that when the directional trim is installed in the light fixture at a later time, the directional trim is in the proper orientation. However, a problem encountered with the installation of recessed light fixtures with directional trims is that in some instances, the housings for the recessed light fixtures are installed in an incorrect orientation for the directional trim that will be installed at a later time. In other words, existing directional trims have attachment mechanisms, such as torsion springs with brackets, that only fit within the light fixture housing in certain orientations. When the recessed light fixture housing is installed in the wrong orientation, the existing directional trims will also have the wrong orientation when inserted into the incorrectly installed recessed light fixture housing. When these problems are encountered, the housing must be removed and reinstalled in the correct orientation in order for the later inserted directional trim to have the correct orientation. Such removal and reinstallation of a housing for a recessed light fixture can be time consuming and expensive.

SUMMARY

The present disclosure relates generally to light fixtures, and more particularly to an adjustable trim that can be used with a light fixture. In one example embodiment, a luminaire comprises a housing, at least two mounting members configured to attach to the housing, a trim assembly attached to the at least two mounting members, and a light module configured to couple to a top flange of the trim assembly. The trim assembly further comprises a bottom flange, a reflector, and an adjustable collar mounted between the top flange of the trim assembly and the light module. The reflector can comprise a downlight reflector portion and a kicker reflector portion. The housing can comprise a plaster ring or frame and receivers for receiving the mounting members. The adjustable collar and the mounting members can be detached from the top flange of the trim assembly so that the adjustable collar and the mounting members can be attached at alternate attachment points on the top flange thereby altering the orientation of the trim assembly when inserted into the luminaire housing.

In another example embodiment, a trim assembly comprises a top flange with a plurality of attachment points, a bottom flange, a trim body disposed between the top flange and the bottom flange, and an adjustable collar mounted to a top side of the top flange. A pair of mounting members can be attached to the trim assembly. The orientation of the trim assembly can be modified by detaching the adjustable collar and the mounting members from the top flange and reattaching the adjustable collar and the mounting members at alternate attachment points on the top flange.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
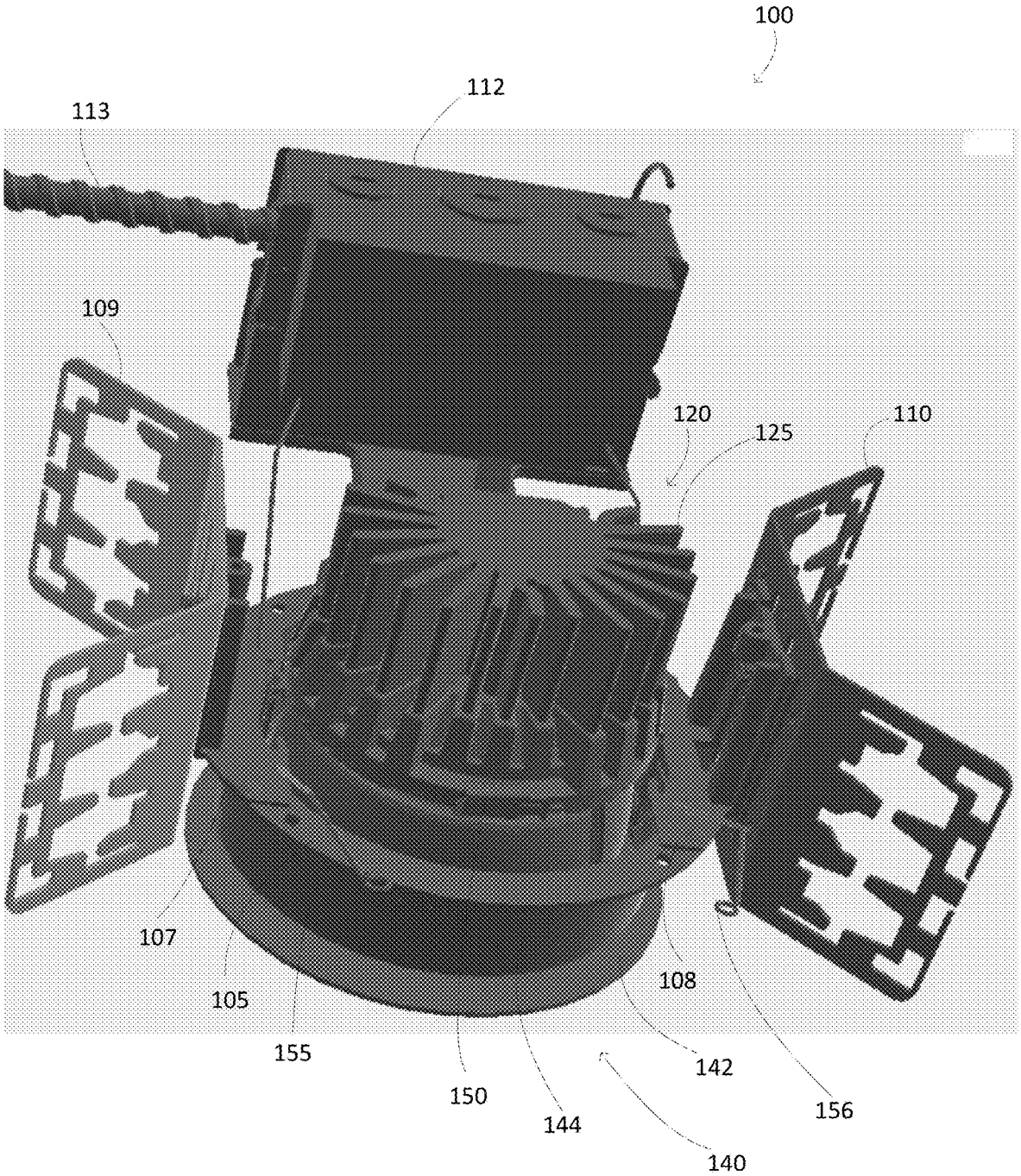
FIG. 1 illustrates a light fixture that includes an adjustable trim collar according to an example embodiment of the present disclosure.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals used in different drawings designate like or corresponding but not necessarily identical elements.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

The example embodiments described herein relate to a recessed light fixture with a trim assembly that can be easily adjusted for varying orientation within a light fixture housing. However, it should be understood that the example embodiments described herein are representative and the disclosure can be applied to other types of light fixtures, such as surface mounted light fixtures and pendant light fixtures.

In certain example embodiments, the example light fixtures are subject to meeting certain standards and/or requirements. For example, the National Electric Code (NEC), the National Electrical Manufacturers Association (NEMA), the International Electrotechnical Commission (IEC), the Federal Communication Commission (FCC), and the Institute of Electrical and Electronics Engineers (IEEE) set standards as to electrical enclosures (e.g., light fixtures), wiring, and electrical connections. As another example, Underwriters Laboratories (UL) sets various standards for light fixtures, including standards for heat dissipation. Use of example embodiments described herein meet (and/or allow a corresponding device to meet) such standards when required.

Any light fixture components (e.g., housings or trim assemblies), described herein can be made from a single piece (e.g., as from a mold, injection mold, die cast, 3-D printing process, extrusion process, stamping process, or other prototype methods). In addition, or in the alternative, a luminaire (or components thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

A coupling feature (including a complementary coupling feature) as described herein can allow one or more components and/or portions of an example trim assembly or other component of a light fixture to become coupled, directly or indirectly, to another portion of the example trim assembly or other component of a light fixture. A coupling feature can include, but is not limited to, a snap, Velcro, a clamp, a portion of a hinge, an aperture, a recessed area, a protrusion, a slot, a spring clip, a tab, a detent, and mating threads. One portion of an example trim assembly can be coupled to a light fixture by the direct use of one or more coupling features.

In addition, or in the alternative, a portion of a light fixture can be coupled using one or more independent devices that interact with one or more coupling features disposed on a component of the trim assembly or other component of a light fixture. Examples of such devices can include, but are not limited to, a pin, a hinge, a fastening device (e.g., a bolt, a screw, a rivet), epoxy, glue, adhesive, tape, and a spring. One coupling feature described herein can be the same as, or different than, one or more other coupling features described herein. A complementary coupling feature (also sometimes called a corresponding coupling feature) as described herein can be a coupling feature that mechanically couples, directly or indirectly, with another coupling feature.

Terms such as "first", "second", "top", "bottom", "side", "distal", "proximal", and "within" are used merely to distinguish one component (or part of a component or state of a component) from another. Such terms are not meant to denote a preference or a particular orientation, and are not meant to limit the embodiments described herein. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Referring now to FIG. 1, an example light fixture 100 comprising a trim assembly with an adjustable collar is illustrated. The example light fixture 100 is a recessed fixture for installation in a ceiling. The primary components of the example light fixture 100 comprise a housing, a light module 120, and a trim assembly 140. The housing can comprise a plaster ring 105, mounting member receivers 107 and 108, and butterfly brackets 109 and 110. The butterfly brackets 109 and 110 are attached to the plaster ring 105 and are configured to mount behind a ceiling so that the light module 120 and trim assembly 140 can be positioned in an aperture in the ceiling. In alternate embodiments, other types of housings can be employed that may or may not use plaster rings and butterfly brackets. For example, in one alternate embodiment, the housing can comprise a cylindrical shaped can that attaches to a plaster frame that rests on the back side of the ceiling. The mounting member receivers 107 and 108 in the example shown in FIG. 1 are attached to the plaster ring 105 and are configured to receive torsion springs 155 and 156 that are attached to the trim assembly 140 via brackets. However, in alternate embodiments, other types of mounting members and receivers can be employed. Lastly, the example housing shown in FIG. 1 includes a junction box 112 and conduit 113.

In a typical installation process, the housing is first installed in the ceiling. At a later point in time, the light module and trim assembly are inserted into the housing. Often times, the trim assembly may be configured to direct light from the light module in an asymmetric distribution, such as directing more light towards a wall or display. The positions of the mounting members (torsion springs 155 and 156 and attached brackets) and the receivers 107 and 108 only permit the trim assembly to be inserted into the housing in the orientation shown in FIG. 1 or rotated 180 degrees. Restricting the orientation of the trim assembly to these two positions can be a problem if alternate orientations are desired or if the housing is installed in an incorrect orientation. The adjustability of the trim assembly, as shown in FIGS. 2-4 and described below, addresses the restricted orientation of conventional trim assemblies.

Referring again to FIG. 1, the light module 120 can be attached to the trim assembly 140 with one or more clips 150 located along the perimeter of the trim assembly. The clips 150 in the example light fixture 100 are attached so that they rotate outward to permit placing the light module 120 on the trim assembly 140, and rotate inward to lock the light module 120 into position after being placed on the trim assembly 140. The light module includes heat sink 125 and a light source (not visible in FIG. 1) disposed on the bottom side of the heat sink. The light source can be any of a variety of lighting technologies including one or more light emitting diodes or one or more organic light emitting diodes. The light source is oriented on the bottom of the light module 120 so that emitted light is directed out of an aperture in the trim assembly.

In the example of FIG. 1, the trim assembly 140 comprises a bottom flange 142, a top flange (not visible in FIG. 1), and a trim body 144 located between the bottom and top flanges. As will be described in connection with FIGS. 2-4 below, the trim body can have a variety of forms. For example, the trim body can comprise one or more reflector portions giving the trim assembly 140 a particular orientation that directs light from the light module in an asymmetric pattern so that more light is transmitted in one direction than another direction.

Figure 2:
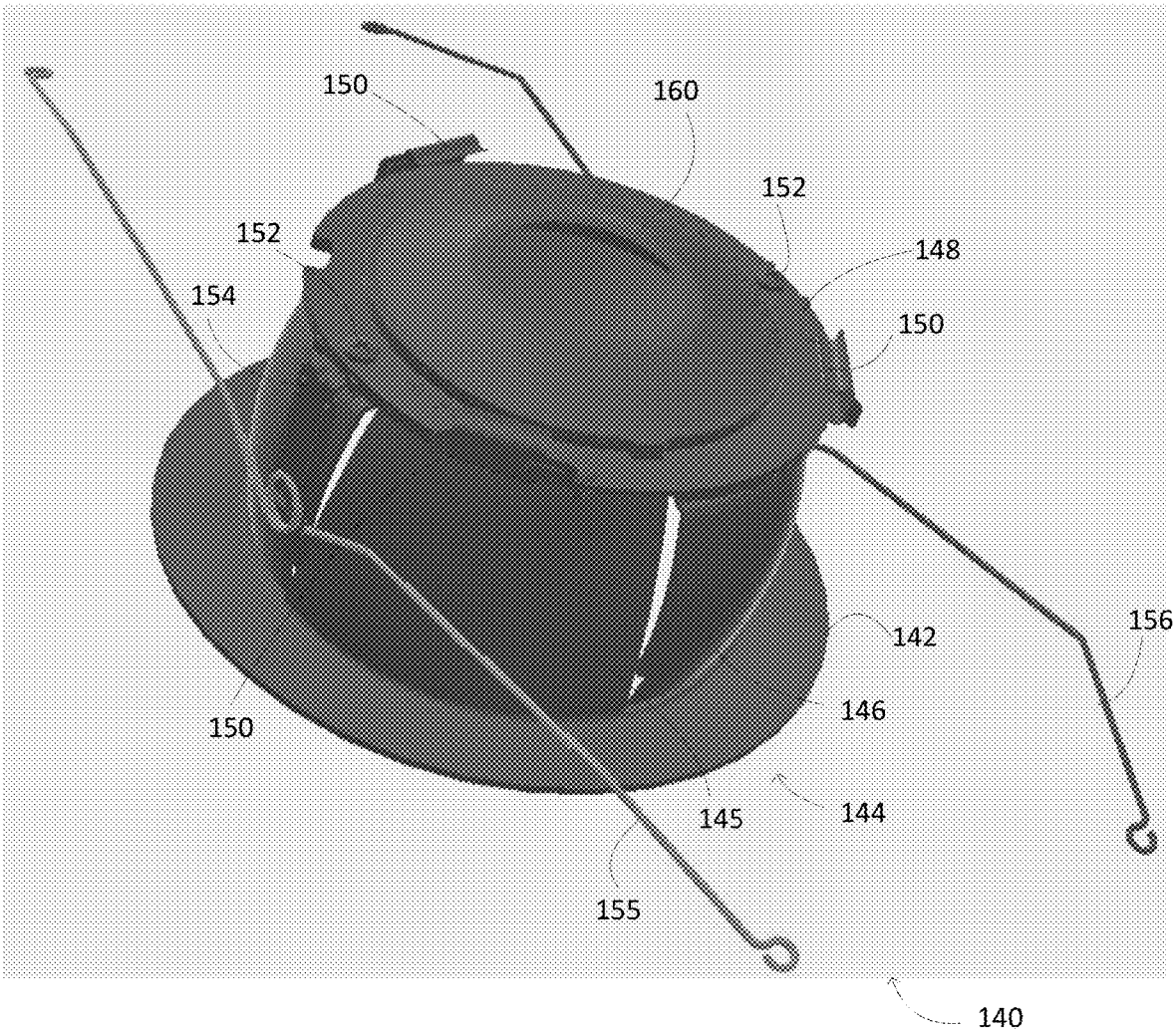
FIG. 2 illustrates the trim assembly of the light fixture of FIG. 1 according to an example embodiment.
Figure 3:
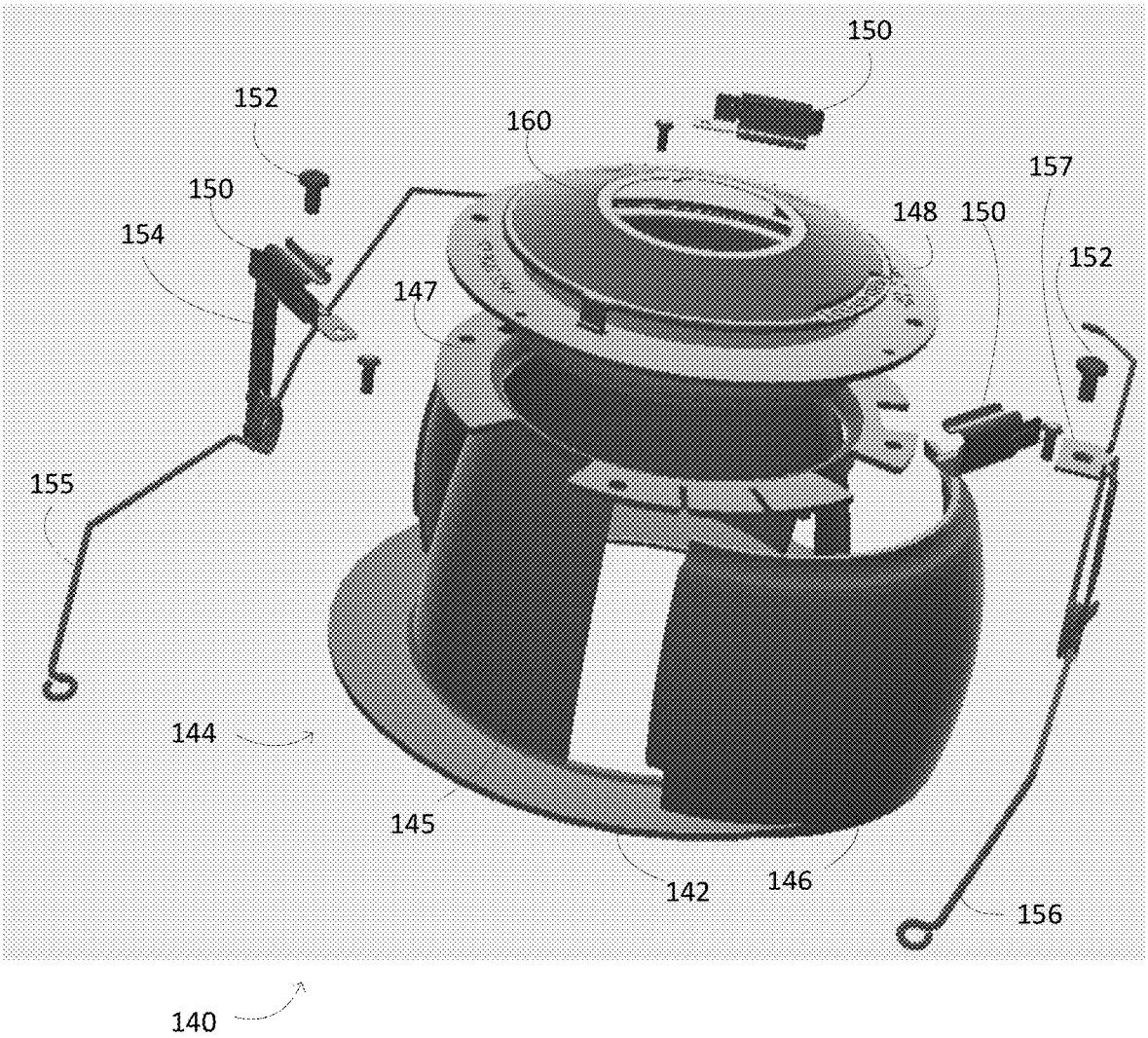
FIG. 3 illustrates an exploded view of the trim assembly of FIG. 2 according to an example embodiment.
Figure 4:
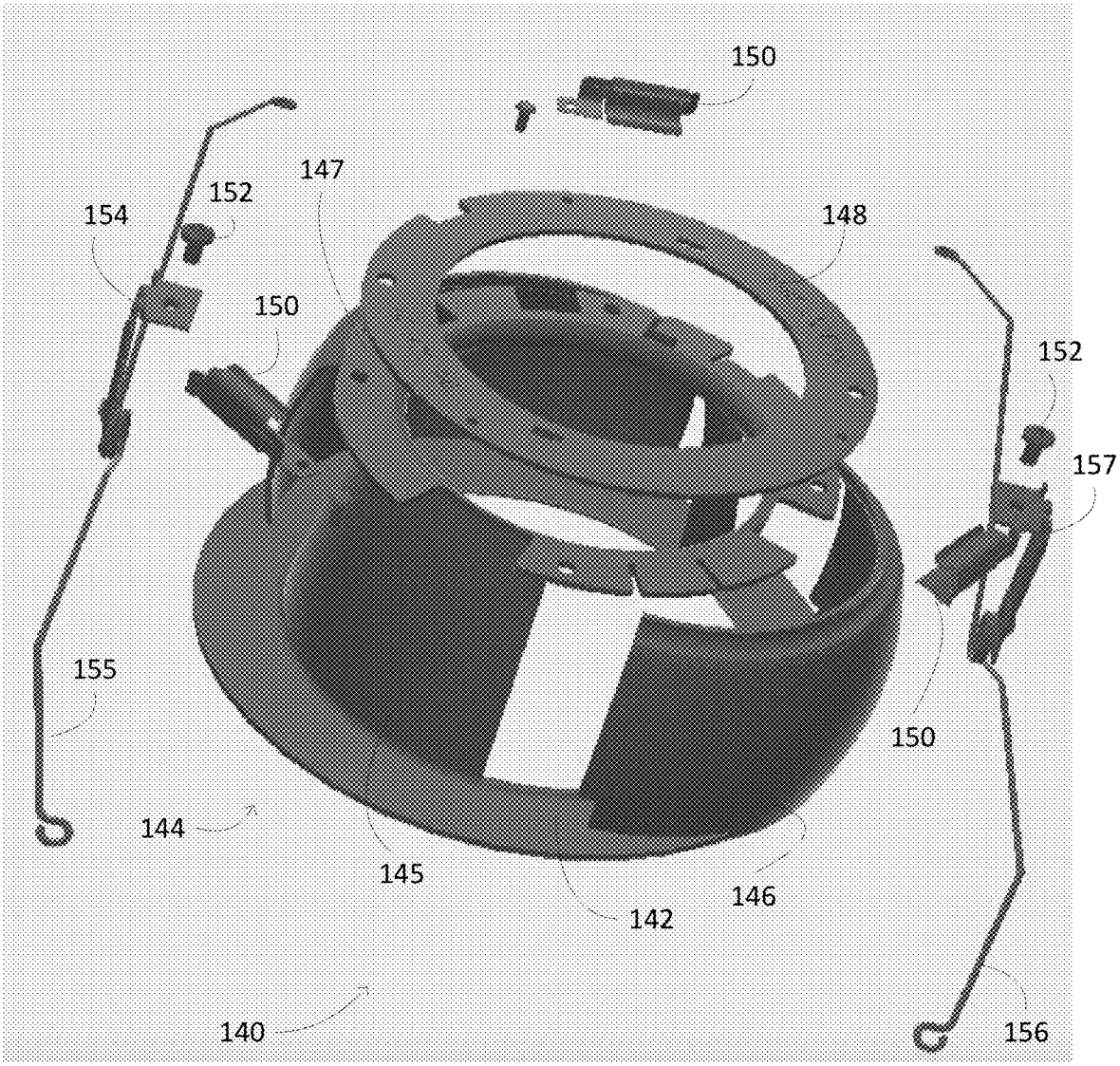
FIG. 4 illustrates another exploded view of the trim assembly of FIG. 2 according to an example embodiment.

Referring now to FIGS. 2-4, illustrations of the trim assembly 140 are provided. FIG. 2 shows a top perspective view of the trim assembly 140 in an assembled state, whereas FIGS. 3 and 4 provide exploded views of the trim assembly 140. Referring to FIG. 2, the trim assembly comprises a bottom flange 142, a top flange 147 (visible in FIGS. 3 and 4), and a trim body 144 between the bottom flange 142 and the top flange 147. The trim body 144 can comprise a variety of reflector portions. In the example shown in FIG. 2, the trim body 144 comprises a downlight reflector portion 146 and a kicker reflector portion 145. As indicated by the gaps visible in FIG. 2 between the downlight reflector portion 146 and the kicker reflector portion 145, the kicker reflector portion 145 is angled further inward towards the interior of the trim assembly 140 so that the kicker reflector portion 145 will bias more of the light exiting the light fixture in a direction away from the kicker reflector portion 145. The location of the kicker reflector portion 145 gives the trim assembly 140 a defined orientation that should be aligned properly when inserted into a light fixture housing so that the kicker reflector portion 145 properly reflects light.

The trim assembly 140 shown in FIG. 2 also comprises an adjustable collar 148 attached to a top flange 147 (visible in FIGS. 3 and 4) of the trim assembly 140. An upper reflector 160 is attached to the top side of the adjustable collar 148. When the light fixture is assembled, a light module is positioned on top of the adjustable collar 148 and the upper reflector 160 and locked into place by fastening devices such as clips 150. The center of the upper reflector 160 includes a light aperture through which emitted light from the light module exits. The bottom surface of the upper reflector 160 comprises a reflective material to reflect in a downward direction any portions of the emitted light that are emitted at a wide angle.

The adjustable collar 148 is attached to the trim assembly 140 via fasteners 152 located on opposite sides of the adjustable collar 148. While screws are shown as the example fasteners 152 in FIG. 2, a variety of fasteners can be used to attach the adjustable collar to the trim assembly. As will be described further in connection with FIGS. 3 and 4, mounting members in the form of torsion springs and torsion spring brackets are also secured to the trim assembly 140 by fasteners 152.

Referring now to FIGS. 3 and 4, exploded views of the trim assembly 140 are shown. The exploded view in FIG. 3 includes the upper reflector 160, whereas the upper reflector 160 has been removed from the exploded view shown in FIG. 4. The views in FIGS. 3 and 4 further illustrate how the downlight reflector portion 146 and the kicker reflector portion 145 are arranged to make up the trim body 144. It should be understood that in alternate embodiments, the trim body 144 can comprise a single component and can have a variety of shapes.

The exploded views in FIGS. 3 and 4 also further illustrate the arrangement of the mounting members and the adjustable collar 148. In the example of FIGS. 3 and 4, the mounting members are torsion spring brackets 154 and 157 with corresponding torsion springs 155 and 156. The example torsion spring brackets 154 and 157 each have a hole through the horizontal top portion of the bracket through which the fasteners 152 can pass to secure the brackets 154 and 157 to the trim assembly 140. The torsion springs 155 and 156 attach to the bottom portions of the brackets 154 and 157. The ends of the torsion springs can be fit into receivers in the housing, such as receivers 107 and 108 shown in FIG. 1, thereby securing the trim assembly 140 and the light module to the housing. It should be understood that in alternate embodiments, other types of mounting members, such as friction clips, can be used.

The adjustable collar 148 and the top flange 147 work together to provide flexibility in the orientation of the trim assembly 140. As shown in the example of FIGS. 3 and 4, the adjustable collar comprises apertures through which the fasteners 152 pass. Similarly, the top flange 147 comprises apertures through which the fasteners 152 can pass. However, the apertures in the top flange 147 comprise a plurality of attachment points for the adjustable collar 148 and fasteners 152. For example, the adjustable collar 148 can be rotated to align with different subsets of apertures (attachment points) on the top flange 147. In the example shown in FIGS. 3 and 4, the apertures of the adjustable collar 148 are aligned with a first subset of apertures (attachment points) on the top flange 147. However, the adjustable collar 148 can also be rotated 90 degrees to align the apertures of the adjustable collar 148 with a second subset of apertures (attachment points) on the top flange 147. The second subset of apertures on the top flange permits attachment of the adjustable collar 148 and torsion spring brackets 154 and 157 at an alternate 90 degree rotated orientation for the trim assembly 140, thereby permitting insertion of the trim assembly 140 into a housing in an alternate position. In other embodiments, additional apertures (attachment points) can be located along the top flange 147 to provide additional orientations other than a 90 degree rotated orientation of the trim assembly 140. For example, additional apertures (attachment points) can be located along the top flange 147 at a variety of positions so that the trim assembly can be rotated 45 degrees, 135 degrees, 270 degrees or some other angular rotation in order to orient the trim assembly 140 in the desired position for insertion into a housing.

Once the adjustable collar 148 and the mounting members are attached to the top flange 147 in the desired orientation, a light module can be placed on top of the trim assembly 140 and secured by the clips 150. After the light module is secured to the trim assembly 140, the light module and trim assembly can be inserted up into a housing of the light fixture and the mounting members (for example, the torsion springs) can be attached to receivers in the housing. Therefore, the adjustable collar and top flange permit the trim assembly 140 to be installed in a light fixture in a variety of rotated orientations to achieve a desired distribution of emitted light exiting the light fixture.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A trim assembly, comprising:

a top flange comprising a plurality of attachment points;

a bottom flange;

a trim body disposed between and attached to the top flange and the bottom flange; and an adjustable collar mounted to a top side of the top flange and attached to a first subset of the plurality of attachment points in a first orientation, wherein the adjustable collar is attachable to the top flange in a second orientation using a second subset of the plurality of attachment points.

2. The trim assembly of claim 1, wherein the trim body comprises a downlight reflector portion and a kicker reflector portion that are oriented differently from each other.

3. The trim assembly of claim 2, wherein the kicker reflector portion is oriented so that light emitted by a light module exits the trim assembly in an asymmetric distribution.

4. The trim assembly of claim 1, further comprising a pair of mounting members coupled to the adjustable collar.

5. The trim assembly of claim 4, wherein the pair of mounting members are torsion springs and torsion spring brackets.

6. The trim assembly of claim 4, wherein the pair of mounting members are configured to attach to a pair of receivers of a housing.

7. The trim assembly of claim 6, wherein the housing comprises a plaster frame.

8. The trim assembly of claim 4, wherein the pair of mounting members each comprise a friction clip.

9. The trim assembly of claim 1, further comprising clips for securing a light module to the trim assembly.

10. The trim assembly of claim 1, wherein the trim assembly further comprises an upper reflector attached to the adjustable collar.

11. The trim assembly of claim 10, wherein the upper reflector is disposed adjacent to a light source when a light module is attached to the trim assembly.

* * * * *